US011317677B2

(12) United States Patent
Auyang

(10) Patent No.: US 11,317,677 B2
(45) Date of Patent: May 3, 2022

(54) ARTICLE WITH SIDE LACING SYSTEM AND METHOD OF LACING AN ARTICLE

(71) Applicant: NIKE, Inc., Beaverton, OR (US)

(72) Inventor: Arick Auyang, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 401 days.

(21) Appl. No.: 16/394,595

(22) Filed: Apr. 25, 2019

(65) Prior Publication Data

US 2019/0343230 A1 Nov. 14, 2019

Related U.S. Application Data

(60) Provisional application No. 62/670,228, filed on May 11, 2018.

(51) Int. Cl.
*A43C 1/00* (2006.01)

(52) U.S. Cl.
CPC ..... *A43C 1/003* (2013.01)

(58) Field of Classification Search
CPC A43C 1/00; A43C 1/003; A43C 11/08; Y10T 24/3742; Y10T 24/3734; Y10T 24/3737
USPC ..... 36/50.1; 24/713.6
See application file for complete search history.

(56) References Cited

U.S. PATENT DOCUMENTS

| | | | | |
|---|---|---|---|---|
| 216,029 | A | 6/1879 | Durocher | |
| 330,501 | A | 11/1885 | Mather | |
| 395,088 | A | 12/1888 | Stevens | |
| 904,416 | A | 11/1908 | Evans | |
| 1,005,488 | A | 10/1911 | Vosburgh | |
| 1,043,003 | A | 10/1912 | Faegre | |
| 1,466,078 | A | 8/1923 | Washburn | |
| 1,559,379 | A | 10/1925 | Rodriguez | |
| 1,767,732 | A | 6/1930 | Breadon | |
| 1,885,297 | A | 11/1932 | Santori | |
| 1,995,243 | A | 3/1935 | Clarke | |
| 2,357,980 | A | 9/1944 | Spiro | |
| 2,591,211 | A * | 4/1952 | Spencer | A43B 3/26 36/97 |

(Continued)

FOREIGN PATENT DOCUMENTS

| | | | |
|---|---|---|---|
| CN | 201042236 | Y | 4/2008 |
| CN | 101558923 | A | 10/2009 |

(Continued)

OTHER PUBLICATIONS

"15 Ways to Tie Your Laces". Need Tricks. URL= "https://www.needtricks.com/15-ways-to-tie-your-laces/". Accessed Sep. 8, 2021. Published as of: Apr. 19, 2017. (Year: 2017).*

(Continued)

*Primary Examiner* — Jameson D Collier
(74) *Attorney, Agent, or Firm* — Quinn IP Law

(57) ABSTRACT

An article such as an article of footwear includes a lacing system having two laces that are routed through lace-receiving passages in two distinct zones of a body of the article. A first lace can be routed through a first set of lace-receiving passages in a first zone, and a second lace can be routed through a second set of lace-receiving passages in a second zone. A method of lacing an article includes routing the first lace and the second lace through the lace-receiving passages of the respective zones.

17 Claims, 7 Drawing Sheets

(56) References Cited

U.S. PATENT DOCUMENTS

| | | | | |
|---|---|---|---|---|
| 3,168,769 | A | 2/1965 | Smith | |
| 3,193,950 | A | 7/1965 | Liou | |
| 3,546,796 | A | 12/1970 | Adams | |
| 3,834,048 | A | 9/1974 | Maurer | |
| 3,934,346 | A | 1/1976 | Sasaki et al. | |
| 4,414,761 | A | 11/1983 | Mahood | |
| 4,442,613 | A * | 4/1984 | Dobbin | A43C 1/003 36/50.1 |
| 4,622,763 | A | 11/1986 | Adams | |
| 5,088,166 | A * | 2/1992 | Lavinio | A43C 1/00 24/712 |
| 5,158,428 | A | 10/1992 | Gessner et al. | |
| 5,293,669 | A | 3/1994 | Sampson | |
| 5,384,971 | A | 1/1995 | Ferry | |
| D389,292 | S | 1/1998 | Egelja | |
| 6,513,211 | B1 | 2/2003 | Fisher | |
| 6,938,913 | B2 | 9/2005 | Elkington | |
| 7,036,194 | B2 | 5/2006 | Tricker | |
| 8,418,381 | B2 | 4/2013 | Reagan et al. | |
| 8,448,353 | B2 | 5/2013 | Seliger | |
| 9,192,204 | B1 | 11/2015 | Liles et al. | |
| 2005/0081403 | A1 | 4/2005 | Mathieu | |
| 2007/0130799 | A1 | 6/2007 | Seliger et al. | |
| 2008/0168685 | A1 | 7/2008 | Kim et al. | |
| 2008/0216351 | A1 | 9/2008 | Carroll et al. | |
| 2009/0100649 | A1 | 4/2009 | Bar et al. | |
| 2013/0019501 | A1 | 1/2013 | Gerber | |
| 2013/0117976 | A1 | 5/2013 | Harris et al. | |
| 2014/0123449 | A1 | 5/2014 | Soderberg et al. | |
| 2015/0096193 | A1 | 4/2015 | Senegal | |
| 2015/0342302 | A1 | 12/2015 | Hahnenberger et al. | |
| 2017/0105489 | A1 | 4/2017 | Lovett | |
| 2017/0202310 | A1 | 7/2017 | Spanks et al. | |
| 2017/0202313 | A1 | 7/2017 | Spanks | |
| 2018/0027926 | A1 | 2/2018 | Tsai | |
| 2019/0343231 | A1 | 11/2019 | Auyang | |
| 2019/0343232 | A1 | 11/2019 | Auyang | |

FOREIGN PATENT DOCUMENTS

| | | |
|---|---|---|
| CN | 202714289 U | 2/2013 |
| DE | 3920266 A1 | 1/1991 |

OTHER PUBLICATIONS

"Howto Bushwalk Lace Chuck Taylors". Classic Sport Shoes. YouTube. URL="https://www.youtube.com/watch?v=Rt2h9s01W-U". Accessed Sep. 8, 2021. Published as of: Apr. 3, 2021. (Year: 2012).*

* cited by examiner

ARTICLE WITH SIDE LACING SYSTEM AND METHOD OF LACING AN ARTICLE

CROSS-REFERENCE TO RELATED APPLICATIONS

This application claims the benefit of priority to U.S. Provisional Application No. 62/670,228, filed May 11, 2018 which is incorporated by reference in its entirety.

TECHNICAL FIELD

The present disclosure relates generally to an article having a lacing system, such as an article of footwear, and a method of lacing an article.

BACKGROUND

Articles of footwear generally include two primary elements: an upper and a sole structure secured to a lower portion of the upper. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper. Likewise, some articles of apparel may include various kinds of closure systems for adjusting the fit of the apparel.

BRIEF DESCRIPTION OF THE DRAWINGS

The embodiments can be better understood with reference to the following drawings and description. The components in the figures are not necessarily to scale unless noted otherwise, emphasis instead being placed upon illustrating the principles of the embodiments. Moreover, in the figures, like reference numerals designate corresponding parts throughout the different views.

DETAILED DESCRIPTION

Figure 1:
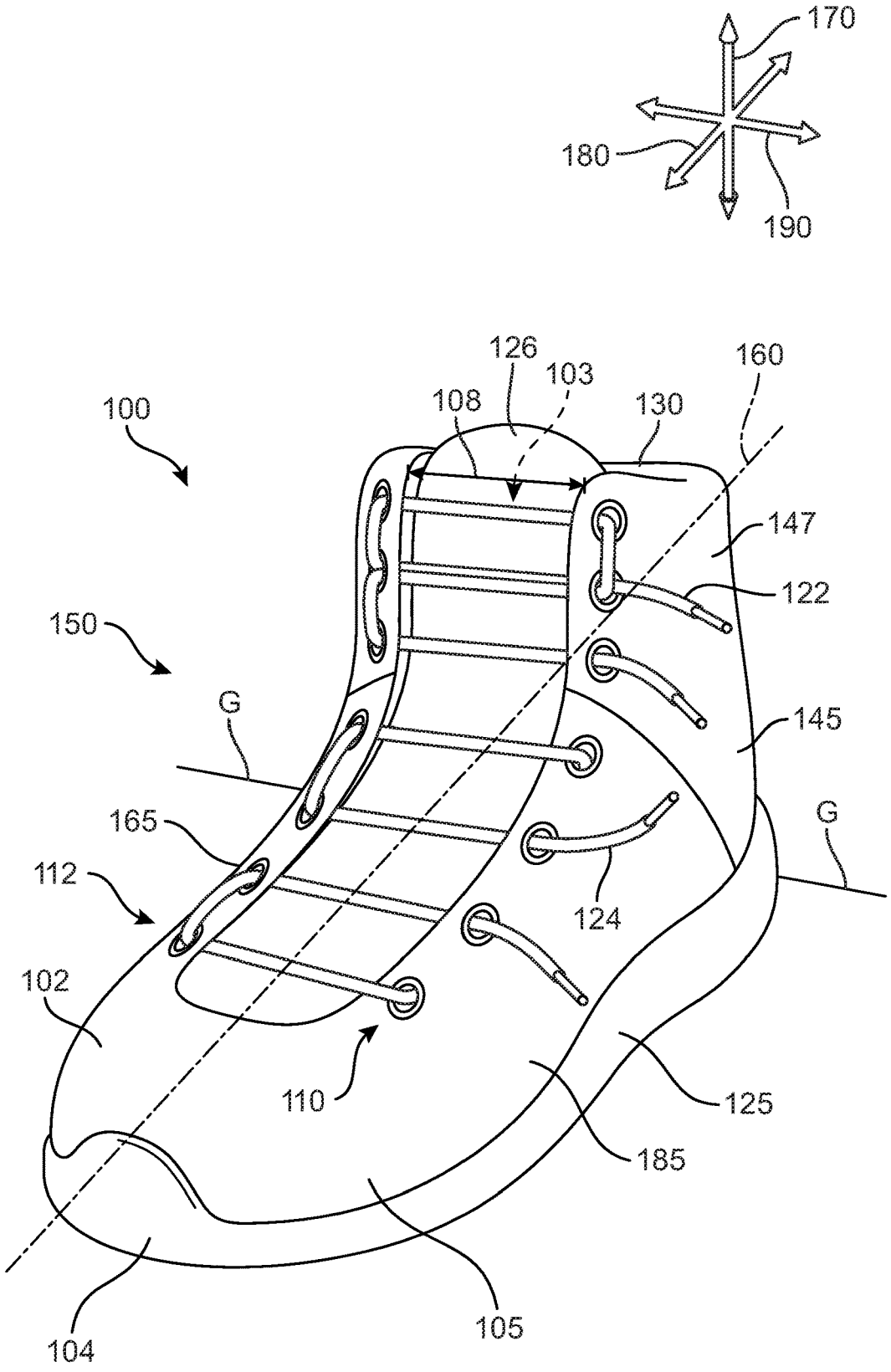
FIG. 1 is an isometric view of an embodiment of an article of footwear.

An article, such as but not limited to an article of footwear, includes a lacing system that can be tensioned to provide zone-specific tightening to fine tune the fit of the article in different regions of the article. More specifically, an article may comprise a body having a first portion and a second. The article may further comprise a lacing system including a first set of rows of lace-receiving passages in a first zone of the body, and a second set of rows of lace-receiving passages in a second zone of the body. Each row of the first set and of the second set may include a lace-receiving passage on the first portion and a lace-receiving passage on the second portion. The lacing system may include a first lace and a second lace. The first lace may be routed through each lace-receiving passage of the first set and may have a first end and a second end both exiting from different rows of the lace-receiving passages of the first set on a same one of the first portion or the second portion. The second lace may be routed through each lace-receiving passage of the second set and may have a first end and a second end both exiting from different intermediate rows of the lace-receiving passages of the second set on the same one of the first portion or the second portion as the lace-receiving passages from which the first end and the second end of the first lace exit. The lacing pattern allows approximately 90 degree turns of the laces, and, at many of the rows, prevents each of the laces from crisscrossing or overlapping itself. These features help reduce friction encountered by the laces during tightening and may lessen wear on the laces.

In an aspect of the disclosure, the second lace may extend through each of the lace-receiving passages of the second zone only once. This may lessen friction on the lace and the associated force required to tension the lace.

In an aspect of the disclosure, the first lace may extend directly between all adjacent rows in the first zone. In another aspect of the disclosure, the second lace may extend directly between alternating adjacent rows in the second zone, and directly between only some non-adjacent rows in the second zone. In one example, the first set of rows includes three rows, and the second set of rows includes four rows. The second lace may extend under the body directly from the lace-receiving passages in an end row of the second set to a lace-receiving passage in another end row of the second set. This may lessen wear on this portion of the second lace.

In an aspect of the disclosure, the first lace tensions the first zone when the first end of the first lace and the second end of the first lace are pulled, and the second lace tensions the second zone of the body independently of the first lace and the first zone when the first end of the second lace and the second end of the second lace are pulled.

In an aspect of the disclosure, the article may be an article of footwear, the body may be an upper, the first portion may be a medial side of the upper, the second portion may be a lateral side of the upper, and the first zone may be disposed further rearward relative to the second zone.

In an aspect of the disclosure, a clasp device may be secured to the first end of the first lace and to the second end of the first lace. A clasp device may also be secured to the first end of the second lace and to the second end of the second lace. Alternatively, the first end and the second end of the first lace may be tied to one another and/or the first end and the second end of the second lace may be tied to one another.

Within the scope of the disclosure, an article of footwear may comprise an upper having a first portion and a second portion, and a lacing system. The lacing system may comprise multiple rows of lace-receiving passages disposed in a first zone of the upper, each row including a lace-receiving passage disposed on the first portion and a lace-receiving passage disposed on the second portion. The lacing system may also comprise multiple rows of lace-receiving passages disposed in a second zone of the upper spaced apart from the first zone of the upper, each row including a lace-receiving passage disposed on the first portion and a lace-receiving passage disposed on the second portion. The lacing system may include a first lace extending through each of the lace-receiving passages in the first zone and having a first end and a second end exiting from two consecutive ones of the lace-receiving passages in the first zone both disposed at the first portion or both disposed at the second portion. The lacing system may include a second lace extending through each of the lace-receiving passages in the second zone and having a first end and a second end exiting from two consecutive ones of the lace-receiving passages in the second zone both disposed at the first portion or both disposed at the second portion. At least one row of the multiple rows in the second zone may be between the first zone and the two consecutive ones of the lace-receiving passages in the second zone from which the first end and the second end of the second lace exit.

In an aspect of the disclosure, the upper may be tensioned in the first zone by the first lace independently of the second lace by pulling at least one of the first end and the second end of the first lace and securing the first end and the second end of the first lace to one another. Furthermore, the upper may be tensioned in the second zone by the second lace independently of the first lace by pulling at least one of the first end and the second end of the second lace and securing the first end and the second end of the second lace to one another.

In one aspect of the disclosure, at least some of the lace-receiving passages may be but are not limited to eyelets extending through the upper (i.e., from an outer surface of the upper to an inner surface of the upper).

In one aspect of the disclosure, the first portion may be a medial side of the upper, and the second portion may be a lateral side of the upper. In one aspect of the disclosure, the first zone may be rearward of the second zone. For example, the first zone may be in heel region or an ankle region of the upper, and the second zone may be in a forefoot region of the upper. The upper may be a high-top upper, the first zone may be in an ankle region of the upper, and the second zone may be in a forefoot region of the upper in one or more embodiments.

In one aspect of the disclosure, the two consecutive ones of the lace-receiving passages from which the first end and the second end of the first lace exit may be in rows of the multiple rows in the first zone that are nearest the second zone.

In one aspect of the disclosure, the two consecutive ones of the lace-receiving passages from which the first end and the second end of the second lace exit may be middle rows of the multiple rows in the second zone.

In one aspect of the disclosure, the multiple rows of lace-receiving passages disposed in the first zone may be three rows, and the multiple rows of lace-receiving passages disposed in the second zone may be four rows.

In one aspect of the disclosure, the article of footwear may further comprise a clasp device secured to the first end and the second end of one of the first lace and the second lace.

Within the scope of the disclosure, a method of lacing an article that has a body with a first portion and a second portion may comprise routing a first lace through each lace-receiving passage of a first set of rows of lace-receiving passages in a first zone of the body such that a first end and a second end of the first lace exit from different rows of the lace-receiving passages of the first set on a same one of the first portion or the second portion, and routing a second lace routed through each lace-receiving passage of a second set of rows of lace-receiving passages in a second zone of the body such that a first end and a second end of the second lace exit from different intermediate rows of the lace-receiving passages of the second set on said same one of the first portion or the second portion. Each row of the first set and each row of the second set may include a lace-receiving passage on the first portion and a lace-receiving passage on the second portion.

In an aspect of the disclosure, routing the first lace may include extending the first lace directly between all adjacent rows in the first zone on the first portion. In an aspect of the disclosure, routing the second lace may include extending the second lace directly between alternating adjacent rows in the second zone, and directly between only some non-adjacent rows in the second zone.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

The following discussion and accompanying figures disclose articles of footwear and a method of assembly of an article of footwear. Concepts associated with the footwear disclosed herein may be applied to a variety of athletic footwear types, including but not limited to running shoes, basketball shoes, soccer shoes, baseball shoes, football shoes, and golf shoes, for example, and any of which may be low-top, high-top, or other styles. Accordingly, the concepts disclosed herein apply to a wide variety of footwear types.

To assist and clarify the subsequent description of various embodiments, various terms are defined herein. Unless otherwise indicated, the following definitions apply throughout this specification (including the claims). For consistency and convenience, directional adjectives are employed throughout this detailed description corresponding to the illustrated embodiments.

The term "longitudinal", as used throughout this detailed description and in the claims, refers to a direction extending along a length of a component. For example, a longitudinal direction of an article of footwear extends between a forefoot region and a heel region of the article of footwear. The term "forward" is used to refer to the general direction from the heel region toward the forefoot region, and the term "rearward" is used to refer to the opposite direction, i.e., the direction from the forefoot region toward the heel region.

The term "lateral direction" or "transverse direction", as used throughout this detailed description and in the claims, refers to a side-to-side direction extending along a width of a component. In other words, the lateral direction may extend between a medial side and a lateral side of an article of footwear, with the lateral side of the article of footwear being the surface that faces away from the other foot, and the medial side being the surface that faces toward the other foot.

The term "side", as used in this specification and in the claims, refers to any portion of a component facing generally in a lateral, medial, forward, or rearward direction, as opposed to an upward or downward direction.

The term "vertical", as used throughout this detailed description and in the claims, refers to a direction generally perpendicular to both the lateral and longitudinal directions. For example, in cases where a sole structure is planted flat on a level ground surface, the vertical direction may extend from the ground surface upward. It will be understood that each of these directional adjectives may be applied to individual components of a sole structure. The term "upward" refers to the vertical direction heading away from a ground surface, while the term "downward" refers to the vertical direction heading toward the ground surface. Similarly, the terms "top", "upper", and other similar terms refer to the portion of an object substantially furthest from the ground in a vertical direction, and the terms "bottom", "lower", and other similar terms refer to the portion of an object substantially closest to the ground in a vertical direction.

The "interior" of an article of footwear such as a shoe refers to space that is occupied by a wearer's foot when the shoe is worn. The "inner side" or "inner surface" of a panel or other footwear element refers to the face of that panel or element that is oriented toward the shoe's interior in a completed article of footwear. The "exterior", "outer side" or "outer surface" of an element refers to the face of that element that is oriented away from the shoe's interior in the completed article of footwear. In some cases, the inner side of an element may have other elements between that inner side and the interior in the completed article of footwear. Similarly, an outer side of an element may have other elements between that outer side and the space external to the completed article of footwear. Further, the terms "inward" and "inwardly" shall refer to the direction toward the interior of the article of footwear, and the terms "outward" and "outwardly" shall refer to the direction toward the exterior of the article of footwear. In addition, the term "proximal" refers to a direction that is nearer a center of an article of footwear, or is closer toward a foot when the foot is inserted in the article of footwear as it is worn by a user. Likewise, the term "distal" refers to a relative position that is further away from a center of the article of footwear or footwear component such as an upper. Thus, the terms proximal and distal may be understood to provide generally opposing terms to describe the relative spatial position of a footwear layer.

For purposes of this disclosure, the foregoing directional terms, when used in reference to an article of footwear, shall refer to the article of footwear when sitting in an upright position, with the sole structure facing groundward, that is, as it would be positioned when worn by a wearer standing on a substantially level surface.

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

The above features and advantages and other features and advantages of the present teachings are readily apparent from the following detailed description of the best modes for carrying out the present teachings when taken in connection with the accompanying drawings.

Referring to FIG. 1, an isometric view of an article of footwear ("article") 100 that is configured with a lacing system 150 is depicted. In the current embodiment, article 100 is shown in the form of an athletic shoe, such as a basketball shoe. However, in other embodiments, lacing system 150 may be used with any other kind of footwear including, but not limited to, hiking boots, soccer shoes, football shoes, sneakers, running shoes, cross-training shoes, rugby shoes, baseball shoes as well as other kinds of shoes. The article of footwear 100 as shown is a high-top style. In other embodiments, the article of footwear may be a low-top or other style. Moreover, in some embodiments lacing system 150 may be configured for use with various kinds of non-sports-related footwear, including, but not limited to, slippers, sandals, high-heeled footwear, loafers as well as any other kinds of footwear. As discussed in further detail below, a lacing system may not be limited to footwear, and in other embodiments, a lacing system and/or components associated with a lacing system could be used with various kinds of apparel, including clothing, sportswear, sporting equipment, and other kinds of apparel. In still other embodiments, a lacing system may be used with braces, such as medical braces. In the present disclosure, the term "tensile element", "tension component", "tensioning component", "lacing component", "lacing element", or "lace" means an elongated structure having extending continuously between a first end and a second end, capable of routing through lace-receiving passages as described herein, and capable of withstanding a tensile load and includes, but is not limited to, a cable, a strand, a wire, a cord, a thread, or a string, among others. As used herein, an "end" of a lace includes a terminal end of a lace and some portion of the lace at the terminal end, such as for applying a pulling force on the lace, as will be well understood by those skilled in the art.

As noted above, for consistency and convenience, directional adjectives are employed throughout this detailed description. For purposes of general reference, article 100 may be divided into three general regions along a longitudinal axis 180: a forefoot region 105, a midfoot region 125, and a heel region 145. Forefoot region 105 generally includes portions of article 100 corresponding with the toes and the joints connecting the metatarsals with the phalanges. Midfoot region 125 generally includes portions of article 100 corresponding with an arch area of the foot. Heel region 145 generally corresponds with rear portions of the foot, including the calcaneus bone. Forefoot region 105, midfoot region 125, and heel region 145 are not intended to demarcate precise areas of article 100. Rather, forefoot region 105, midfoot region 125, and heel region 145 are intended to represent general relative areas of article 100 to aid in the following discussion. Since various features of article 100 extend beyond one region of article 100, the terms forefoot region 105, midfoot region 125, and heel region 145 apply not only to article 100 but also to the various features of article 100.

Referring to FIG. 1, for reference purposes, a lateral axis 190 of article 100, and any components related to article 100, may extend between a medial side 165 and a lateral side 185 of the article 100. The medial side 165 and the lateral side 185 may also be referred to as a first side and a second side, or as a first portion and a second portion of the upper 102, respectively. Additionally, in some embodiments, longitudinal axis 180 may extend from forefoot region 105 to heel region 145. Heel region 145 extends upward to an ankle region 147. It will be understood that each of these directional adjectives may also be applied to individual components of an article of footwear, such as an upper and/or a sole member. In addition, a vertical axis 170 refers to the axis perpendicular to a horizontal surface defined by longitudinal axis 180 and lateral axis 190. For purposes of this disclosure, it can be understood that different sides of an article can also be identified as a first side or a second side. For example, a first side can comprise medial side 165 and a second side can comprise lateral side 185 in some embodiments. In another embodiment, a first side can comprise lateral side 185 and a second side can comprise medial side 165. In some embodiments, the two sides can be divided generally by a longitudinal midline, also referred to as a central axis 160, extending through the article along a length of the article.

Article 100 may include upper 102 and sole structure 104. Generally, upper 102 may be any type of upper. In particular, upper 102 may have any design, shape, size, and/or color. For example, in embodiments where article 100 is a basketball shoe, upper 102 could be a high-top upper that is shaped to provide high support on an ankle. In embodiments where article 100 is a running shoe, upper 102 could be a low-top upper.

As shown in FIG. 1, upper 102 may include one or more material elements (for example, meshes, textiles, foam, leather, and synthetic leather), which may be joined to define an interior cavity 103 configured to receive a foot of a wearer. The material elements may be selected and arranged to impart properties such as light weight, durability, air permeability, wear resistance, flexibility, and comfort. Upper 102 may define an opening 130 (i.e., an ankle opening) through which a foot of a wearer may be received into the interior cavity 103.

At least a portion of sole structure 104 may be fixedly attached to portions of upper 102 (for example, with adhesive, stitching, welding, or other suitable techniques) and may have a configuration that extends between upper 102 and the ground G. Sole structure 104 may include provisions for attenuating ground reaction forces (that is, cushioning and stabilizing the foot during vertical and horizontal loading). In addition, sole structure 104 may be configured to provide traction, impart stability, and control or limit various foot motions, such as pronation, supination, or other motions.

In some embodiments, sole structure 104 may be configured to provide traction for article 100. In addition to providing traction, sole structure 104 may attenuate ground reaction forces when compressed between the foot and the ground during walking, running, or other ambulatory activities. The configuration of sole structure 104 may vary significantly in different embodiments to include a variety of conventional or nonconventional structures. In some cases, the configuration of sole structure 104 can be configured according to one or more types of ground surfaces on which sole structure 104 may be used.

For example, the disclosed concepts may be applicable to footwear configured for use on any of a variety of surfaces, including indoor surfaces or outdoor surfaces. The configuration of sole structure 104 may vary based on the properties and conditions of the surfaces on which article 100 is anticipated to be used. For example, sole structure 104 may vary depending on whether the surface is hard or soft. In addition, sole structure 104 may be tailored for use in wet or dry conditions.

In some embodiments, sole structure 104 may be configured for a particularly specialized surface or condition. The proposed footwear upper construction may be applicable to any kind of footwear, such as basketball, soccer, football, and other athletic activities. Accordingly, in some embodiments, sole structure 104 may be configured to provide traction and stability on hard indoor surfaces (such as hardwood), soft, natural turf surfaces, or on hard, artificial turf surfaces. In some embodiments, sole structure 104 may be configured for use on multiple different surfaces.

As will be discussed further below, in different embodiments, sole structure 104 may include different components. For example, sole structure 104 may include an outsole, a midsole, a cushioning layer, and/or an insole. In addition, in some cases, sole structure 104 can include one or more cleat members or traction elements that are configured to increase traction with the ground's surface.

In addition, as noted above, in different embodiments, article 100 may include lacing system 150. Lacing system 150 can help article 100 assume an expanded, loose, unsecured, or open state, where the user's foot can be inserted or removed from the foot-receiving cavity 103 of the article 100, and a contracted, secured, closed, or tightened state, where the user's foot is secured within the foot-receiving cavity 103 by the article 100. The lacing system 150 is also referred to as a tensioning system or fastening system as it is configured to tighten the upper around a foot received in the foot-receiving cavity.

Generally, article 100 may be associated with any type of fastening or lacing system including, but not limited to, lacing systems that incorporate laces, straps, zippers, hook and loop fasteners, as well as other types of fastening systems. In the embodiments depicted herein, article of footwear 100 includes a lacing system 150 configured to be used with a tensile component such as a lace.

Lacing system 150 may comprise various components and systems for adjusting the size of opening 130 leading to the interior foot-receiving cavity 103, and tightening (or loosening) upper 102 around a wearer's foot. In some embodiments, lacing system 150 may comprise laces 122, 124, also referred to herein as tensile components or tensile elements 122, 124. A lace as used with article 100 may comprise any type of lacing material known in the art. Examples of laces that may be used include cables or fibers having a low modulus of elasticity as well as a high tensile strength. Generally, a lace may comprise any material including, but not limited to, leather, cotton, jute, hemp, metals, or synthetic fibers. Additionally, a lace may be coated with a material to increase friction in order to keep the lace fastened. In some cases, a lace may include elastic portions.

In different embodiments, each lace 122, 124 may be formed from a continuous strip of material. In some embodiments, a lace may be made of various materials. Examples of various materials that could be used include, but are not limited to, natural leather, synthetic leather, textiles, polymer sheets or strips, as well as other types of natural or synthetic materials. In one embodiment, a lace may be made of a generally inelastic material that resists stretching. In some cases, the material may be a woven or knitted textile material. In other cases, the material may be a plastic or polymer material. In other embodiments, a lace may be made of an elastic material that is configured to stretch in one or more directions. Furthermore, a lace may comprise a single strand of material, or can comprise multiple strands of material. One example of a material for the lace is SPECTRA™, manufactured by Honeywell of Morris Township, N.J., although other kinds of extended chain, high-modulus polyethylene fiber materials can also be used as a lace.

Referring to FIG. 1, lacing system 150 includes a first lace 122 and a second lace 124. In other embodiments, article 100 may include additional laces. In some embodiments, laces 122, 124 may be configured to span a lacing gap 108. In different embodiments, lacing gap 108 may be disposed in various locations on upper 102. In some embodiments, lacing gap 108 may be disposed between medial side 165 and lateral side 185 of upper 102. In other embodiments, lacing gap 108 may be disposed asymmetrically so that a portion of lacing gap 108 is disposed closer to medial side 165 or lateral side 185 of upper 102. The lacing gap 108 may be disposed in the front, in the rear, on the medial side, or on the lateral side of the upper 102. In the embodiment shown, the upper 102 includes a tongue 126 disposed generally under and between the portions of the upper including the lace-receiving elements, so that the lacing gap 108 extends generally over the tongue 126. In addition, as will be discussed further below, laces 122, 124 may be arranged in an asymmetric configuration.

For purposes of this description, the term "asymmetric" is used to characterize a lacing system that has an asymmetry about some common axis. In other words, the medial side of lacing system 150 can include differences with respect to the lateral side of lacing system 150 when lacing system 150 is asymmetric. In contrast, the term "symmetric" is used to characterize a lacing system that has a symmetry about some common axis. In other words, the medial side of lacing system 150 can be substantially similar to the lateral side of lacing system 150 when lacing system 150 is symmetric. In one embodiment, the symmetric configuration represents each of the lateral side and medial side of the lacing system being a mirror image of the other.

In different embodiments, lacing gap 108 may be disposed or extend between a first portion 110 of the upper 102 associated with lateral side 185 of upper 102 and a second portion 112 of the upper 102 associated with medial side 165 of upper 102. The first portion 112 of the upper 102 may be referred to as a medial fastening portion 112 of upper 102, and the second portion 110 of the upper 102 may be referred to as a lateral fastening portion 110 of upper 102. In some embodiments, lateral fastening portion 110 and/or medial fastening portion 112 may include one or more features that receive components of a lacing system. In some embodiments, one or more laces 122, 124 may be associated with lateral fastening portion 110 and/or medial fastening portion 112. In one embodiment, laces may be configured to attach or be routed through upper 102 along lateral fastening portion 110 and/or medial fastening portion 112. In other words, in some cases, lateral fastening portion 110 and/or medial fastening portion 112 can include features such as lace-receiving passages that engage with, route, anchor, or otherwise guide laces 122, 124.

Figure 2:
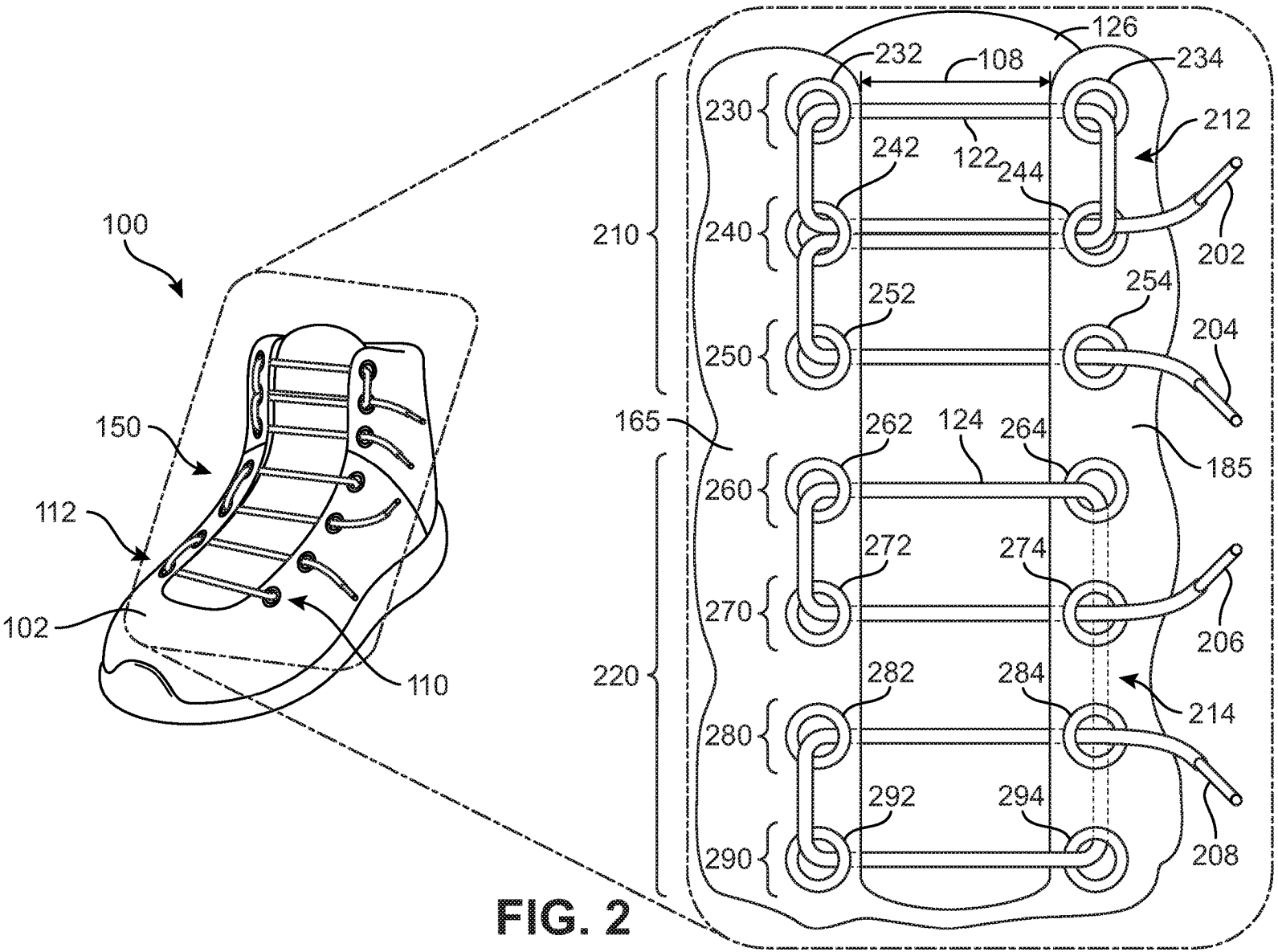
FIG. 2 is an isometric view of the article of footwear of FIG. 1 with a schematic view of an embodiment of a lacing system.

Referring now to FIG. 2, article 100 is depicted with a schematic representation of an embodiment of lacing system 150. It can be seen that lacing system 150 includes at least two laces 122, 124 as noted above. Furthermore, in some embodiments, lacing system 150 can be understood to include a first fastening zone 210 (also referred to as a first zone) associated with first lace 122 and a second fastening zone 220 (also referred to as a second zone) associated with second lace 124. Each fastening zone can include features for engaging with a lace. For example, it can be seen that in some embodiments, a fastening zone can comprise one or more lace-receiving passages, which are configured to allow the threading, routing, or passing through of a lace. In the embodiment shown, the lace-receiving passages are eyelets, and will be referred to herein as such eyelets. The term "lace-receiving passage" or "eyelet" as used throughout this detailed description and in the claims refers to a structure configured to receive or engage with a lace in an article of footwear. For example, in some embodiments, an eyelet may be a small hole or perforation extending through the body of the upper 102. The body of the upper 102 is the one or more layers of material or materials that surround the foot-receiving cavity 103. In some cases, an eyelet or lace-receiving passage may be a hole that is reinforced with a material including, but not limited to, metal, cord, fabric, or leather. In other embodiments, an eyelet or lace-receiving passage may be an opening formed by a loop of material secured to a body of the upper, including, but not limited to, fabric, cord, leather, or metal. In other embodiments, an eyelet or lace-receiving passage may be a structure such as a post or hook extending from the body of the upper that forms a channel configured as a lace-receiving passage. In addition, eyelets may be disposed in a similar location on both lateral side 185 and/or medial side 165 of upper 102, though in other embodiments, eyelets may be formed in an asymmetrical configuration on lateral side 185 relative to medial side 165 of upper 102.

For example, in FIG. 2, it can be seen that first fastening zone 210 comprises a first set of lace-receiving passages 212 (i.e., a first set of eyelets or "rearward eyelets"), and second fastening zone 220 comprises a second set of lace-receiving passages 214 (i.e., a second set of eyelets or "forward eyelets"). The first set of eyelets 212 is rearward of and/or above the second set of eyelets 214. In different embodiments, each fastening zone can include a different number of eyelets, or the same number of eyelets. In FIG. 2, rearward eyelets 212 include a first row of eyelets 230, a second row of eyelets 240, and a third row of eyelets 250. Similarly, forward eyelets 214 include a fourth row of eyelets 260, a fifth row of eyelets 270, a sixth row of eyelets 280, and a seventh row of eyelets 290. For purposes of reference, each row of eyelets includes an eyelet in a first portion of the upper 102 on one side of the lacing gap 108 of FIG. 1, and an eyelet in a second portion of the upper 102 on an opposite side of the lacing gap 108. Each row of eyelets can be understood to comprise an eyelet formed in or associated with medial fastening portion 112 of upper 102, as well as an eyelet formed in or associated with lateral fastening portion 110 of upper 102. Thus, first row of eyelets 230 comprises a first medial eyelet 232 and a first lateral eyelet 234, second row of eyelets 240 comprises a second medial eyelet 242 and a second lateral eyelet 244, third row of eyelets 250 comprises a third medial eyelet 252 and a third lateral eyelet 254, fourth row of eyelets 260 comprises a fourth medial eyelet 262 and a fourth lateral eyelet 264, fifth row of eyelets 270 comprises a fifth medial eyelet 272 and a fifth lateral eyelet 274, sixth row of eyelets 280 comprises a sixth medial eyelet 282 and a sixth lateral eyelet 284, and seventh row of eyelets 290 comprises a seventh medial eyelet 292 and a seventh lateral eyelet 294. The fifth row of eyelets 270 and the sixth row of eyelets 280 are referred to herein as intermediate rows of the second set. Intermediate rows of a set include any rows that are not an end row of the set.

In different embodiments, laces 122, 124 can be routed through the eyelets of each fastening zone to provide a variety of lacing arrangements. Referring again to the schematic representation of lacing system 150 in FIG. 2, in one embodiment, first lace 122 has a first end 202 and a second end 204, and can extend from the first end 202 to the second end 204 through rearward eyelets 212, and second lace 124 has a first end 206 and a second end 208 and can extend from the first end 206 to the second end 208 through forward eyelets 214. The first end 206 and the second end 208 of the second lace 124 may also be referred to herein as the third end 206 and the fourth end 208 for ease of differentiating from the first end 202 and the second end 204 of the first lace 122. In the embodiment of FIG. 2, the upper 102 is a high-top, the first zone 210 is in an ankle region 147 of the upper 102, and the second zone 220 is in a forefoot region 105 of the upper 102.

For purposes of clarity the lacing arrangement depicted in FIG. 2 will be described with reference to the manner or method in which each lace extends between one end and another end during one embodiment of a lacing process. However, it should be understood that the lacing arrangement described herein can be provided by a variety of different steps, and the sequence is not limited by the sequence that is shown in FIGS. 3-8. Any series of steps that produce the configuration shown in FIG. 2 can be used, and the order of each step may vary significantly from that shown in FIGS. 3-8. In other embodiments, there may be a greater or lesser number of steps. In particular, it should be understood that the process depicted in FIGS. 3-8 is merely an example and other methods or steps of routing a lace may be used.

Figure 3:
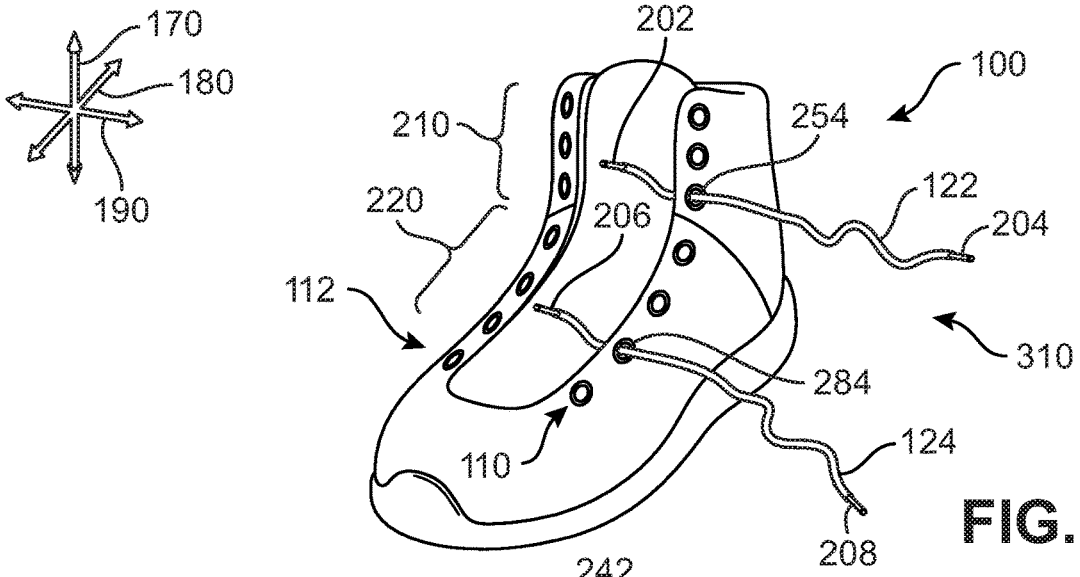
FIG. 3 is an isometric view of the article of footwear of FIG. 1 during a lacing process.
Figure 4:
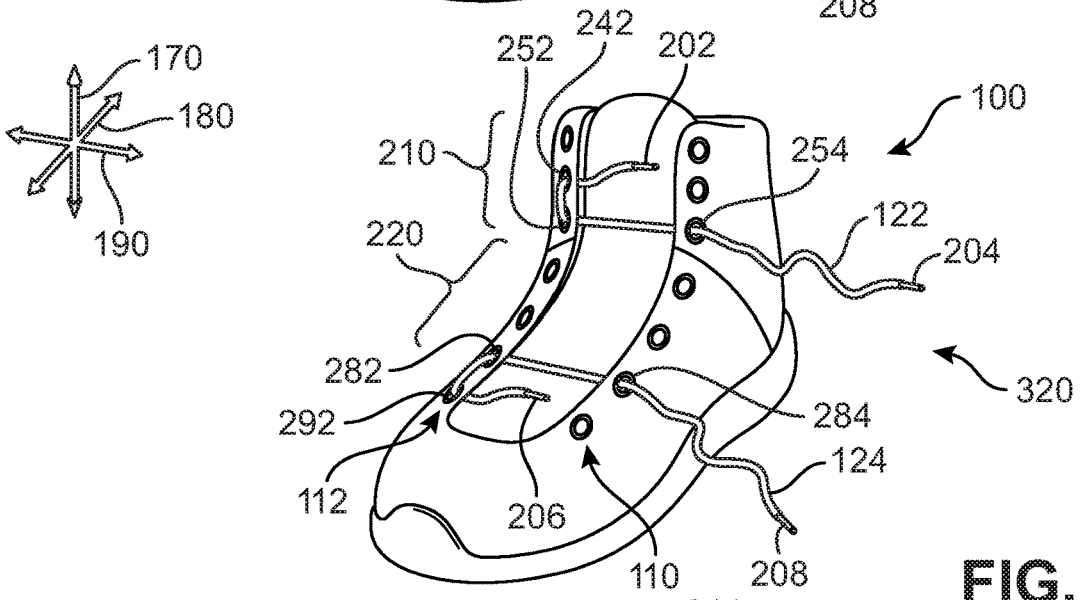
FIG. 4 is an isometric view of the article of footwear of FIG. 3 during a subsequent step of the lacing process.
Figure 5:
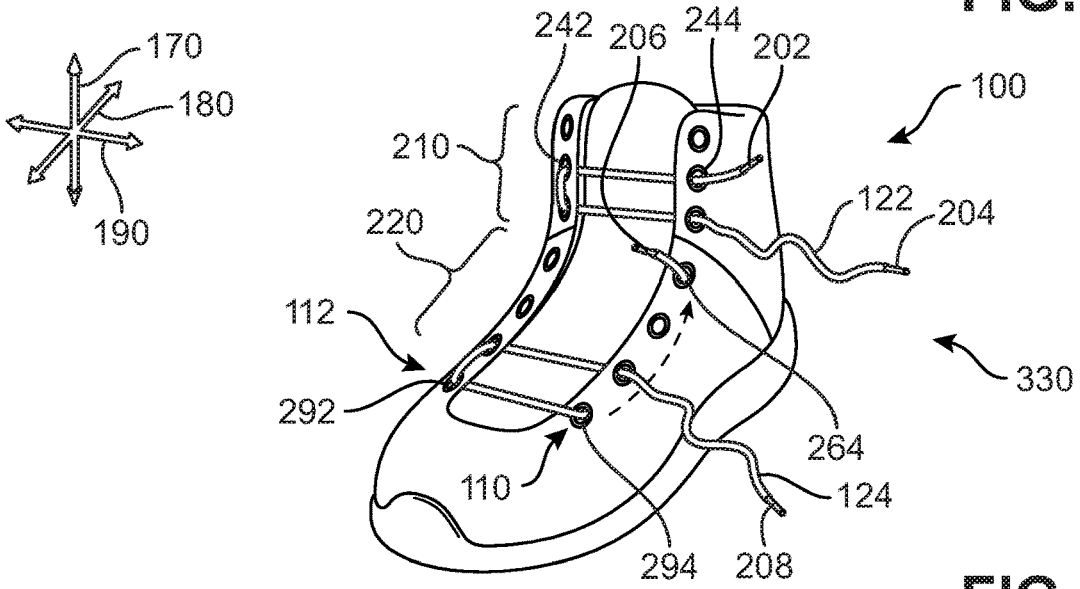
FIG. 5 is an isometric view of the article of footwear of FIG. 4 during a subsequent step of the lacing process.

In FIG. 2, it can be seen that when article 100 is laced, first end 202 of first lace 122 is a free end that emerges from second lateral eyelet 244 and second end 204 is a free end that emerges from third lateral eyelet 254. Referring now to FIGS. 3-5, by arranging, engaging, or routing first end 202 (and other portions of first lace 122) through different eyelets, in some embodiments, first lace 122 can be arranged or oriented in a particular configuration in article 100. For example, as shown in a first step 310, first end 202 is initially routed through third lateral eyelet 254 and extends in a direction substantially aligned with lateral axis 190. In a second series of steps 320, first end 202 is routed beneath (i.e., under the inner surface of the upper 102) and then through third medial eyelet 252 (i.e., outward from the inner surface to the outer surface). Furthermore, in the second series of steps 320 depicted in FIG. 4, emerging from third medial eyelet 252, first end 202 extends in a direction substantially aligned with longitudinal axis 180 above and then through second medial eyelet 242. First end 202 is then routed in a third step 330 depicted in FIG. 5 to extend in a direction substantially aligned with lateral axis 190, extending underneath and then through second lateral eyelet 244.

Figure 6:
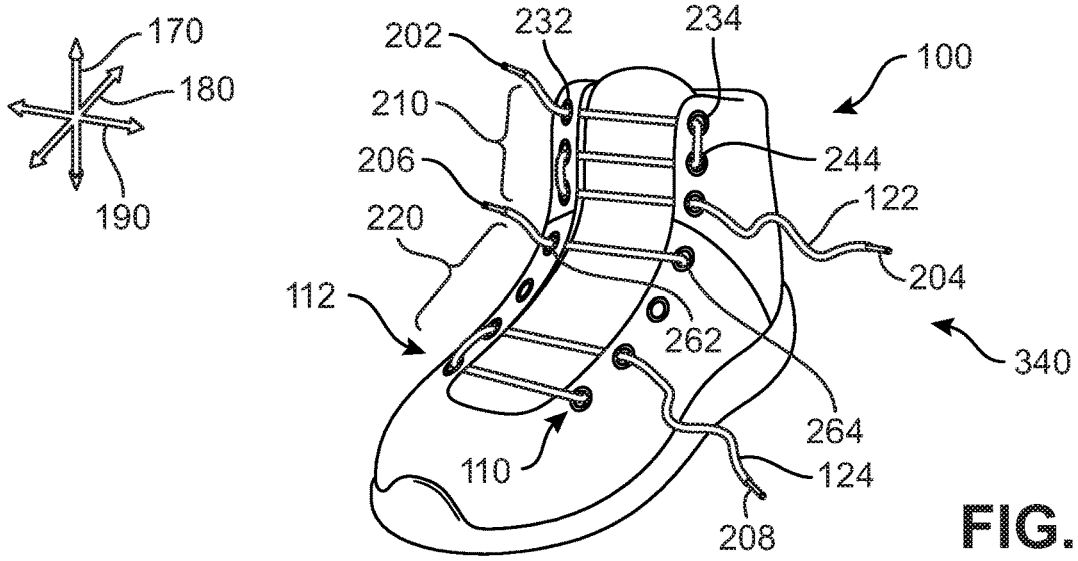
FIG. 6 is an isometric view of the article of footwear of FIG. 5 during a subsequent step of the lacing process.

Referring now to FIG. 6, in a fourth series of steps 340 first lace 122 emerges from second lateral eyelet 244 and is routed such that it extends in a direction substantially aligned with vertical axis 170 above and through first lateral eyelet 234. First end 202 then extends in a direction substantially aligned with lateral axis 190, being routed underneath and then through first medial eyelet 232. In a fifth step 350 depicted in FIG. 7, first end 202 then extends in a direction substantially aligned with vertical axis 170 and passes through second medial eyelet 242. In another embodiment, the lace routing in steps 340 and 350 could be substantially aligned with the longitudinal axis 180 or could be partially aligned with both the vertical axis 170 and the longitudinal axis 180. As first end 202 emerges from second medial eyelet 242, it is routed in a sixth step 360, depicted in FIG. 8, in a direction substantially aligned with lateral axis 190 underneath and then through second lateral eyelet 244, such that first end 202 emerges from second lateral eyelet 244. Thus, in some embodiments, an eyelet may receive or be associated with more than one portion of a lace. Stated differently, two different non-consecutive portions of a single tensile component may extend through an eyelet. Furthermore, in some embodiments, a route or distance between two eyelets may comprise more than one length of a lace. Stated differently, two different non-consecutive portions of a single tensile component may extend between the same two eyelets. For example, in the schematic view of FIG. 2, it can be seen that there are two distinct portions of first lace 122 that each extend between second lateral eyelet 244 and second medial eyelet 242. In some embodiments, two portions of a lace can be arranged such that they at least partially contact each other in the lacing arrangement. In other embodiments, such "doubling" or overlapping of tensile portions can occur in other portions of the fastening zones. In another embodiment, however, there may be no such doubling.

Similarly, in some embodiments, second fastening zone 220 can include a particular lacing arrangement. In FIG. 2, it can be seen that when article 100 is laced, first end 206 of second lace 124 is a free end that emerges from fifth lateral eyelet 274 and second end 208 is a free end that emerges from sixth lateral eyelet 284. Referring to FIGS. 3-5, by arranging, engaging, or routing first end 206 (and other portions of second lace 124) through different eyelets, second lace 124 can be arranged or oriented in a particular configuration in article 100. For example, as shown in first step 310, first end 206 is initially routed through sixth lateral eyelet 284 and extends in a direction substantially aligned with lateral axis 190. In second series of steps 320, first end 206 is routed under and then through sixth medial eyelet 282. Furthermore, emerging from sixth medial eyelet 282, first end 206 extends in a direction substantially aligned with longitudinal axis 180 above and then through seventh medial eyelet 292, as shown in FIG. 4. First end 206 is then routed during third step 330 to extend in a direction substantially aligned with lateral axis 190, extending above and then through seventh lateral eyelet 294. Emerging from a proximal side of seventh lateral eyelet 294, first end 206 is shown extending in a rearward direction (see dotted line) in a direction substantially aligned with longitudinal axis 180, beneath or below lateral fastening portion 110, until it emerges upward and outward (i.e., in a distal direction) from fourth lateral eyelet 264, as shown in FIG. 5. In other words, in some embodiments, there may be substantial portions of a lace that are hidden or disposed beneath portions of upper 102. In particular, in one embodiment, the entire length of a portion of a lace where it extends between one eyelet and another eyelet may be disposed beneath a portion of upper 102, such that it is not readily visible to a wearer.

Figure 7:
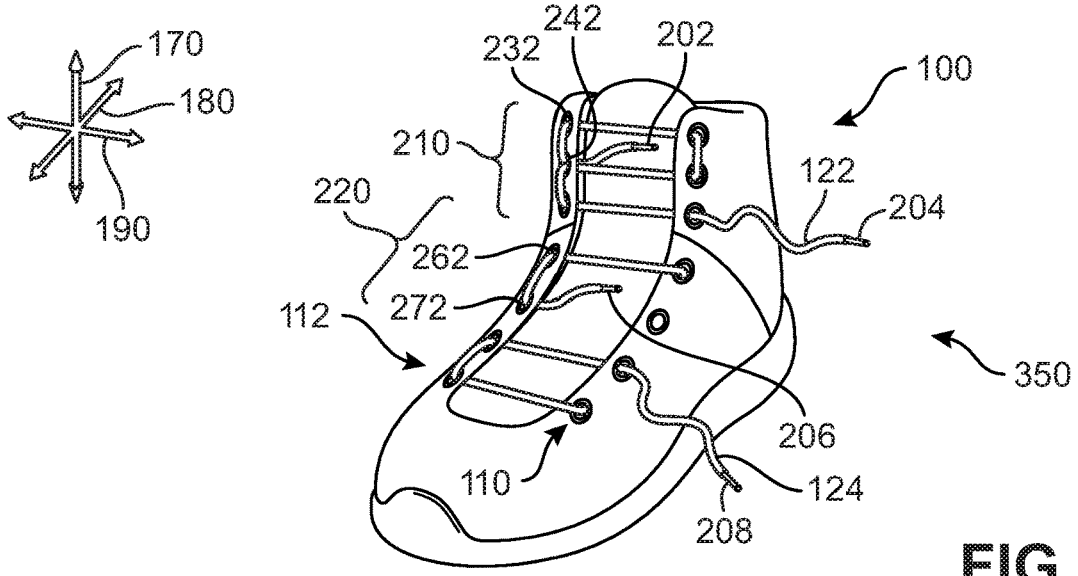
FIG. 7 is an isometric view of the article of footwear of FIG. 6 during a subsequent step of the lacing process.
Figure 8:
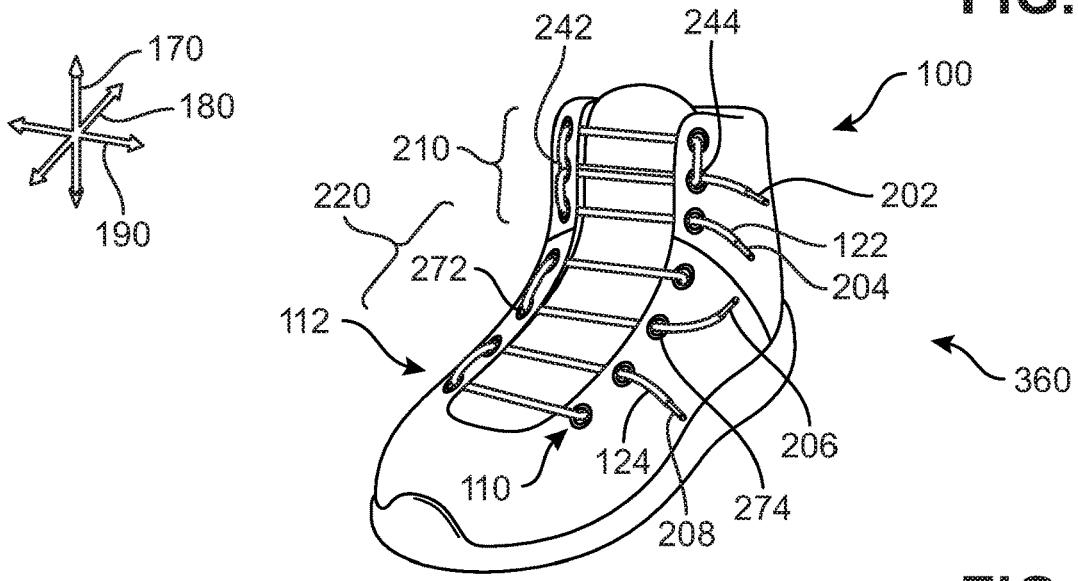
FIG. 8 is an isometric view of the article of footwear of FIG. 7 during a subsequent step of the lacing process.

Referring to FIG. 6, in fourth series of steps 340, second lace 124 is routed such that it extends in a direction substantially aligned with lateral axis 190 underneath and through fourth medial eyelet 262. In fifth step 350, first end 206 is shown as it extends in a direction substantially aligned with longitudinal axis 180, being routed above and then through fifth medial eyelet 272, as shown in FIG. 7. In sixth step 360, first end 206 extends in a direction substantially aligned with lateral axis 190 and passes underneath and through fifth lateral eyelet 274, such that first end 206 emerges from fifth lateral eyelet 274, as shown in FIG. 8.

As shown in FIG. 2, the first lace 122 extends through each of the lace-receiving passages 212 of the first zone 210 and includes a first end 202 and a second end 204 exiting from two consecutive ones of the lace-receiving passages 212 of the first zone 210 disposed at the second portion 185 (i.e., through lateral eyelets 244, 254). The lateral eyelets 244, 254 from which the first end 202 and the second end 204 of the first lace 122 exit are nearest the second zone 220.

The second lace 124 extends through each of the lace-receiving passages 214 of the second zone 220 and includes a first end 206 and a second end 208 exiting from two consecutive ones of the lace-receiving passages 214 of the second zone 220 disposed at the second portion 185 (i.e., through lateral eyelets 274, 284). A row 260 of the multiple rows of lace-receiving passages 212 of the second zone 220 (eyelets 262, 264) are between the first zone 210 and the two consecutive ones of the lace-receiving passages 212 of the second zone 220 (eyelets 274, 284) from which the first end 206 and the second end 208 of the second lace 124 exit. The eyelets 274, 284 of the second zone 220 from which the first end 206 and the second end 208 of the second lace 124 exit are included in middle rows of the multiple rows of lace-receiving passages 214 disposed in the second zone 220. Stated differently, the rows 270, 280 are between row 260 and row 290.

The first lace 122 is routed through each lace-receiving passage of the first set of lace-receiving passages 212 and the first end 202 and the second end 204 exit through two consecutive lace-receiving passages 212 (i.e., through eyelets 244, 254) and are both disposed on the second portion 185 in a tensioned state of the first zone 210. The second lace 124 is routed through each lace-receiving passage of the second set of lace-receiving passages 214, and the first end 206 of the second lace 124 and the second end 208 of the second lace 124 are both disposed on the second portion 185 in the tensioned state of the second zone. In other embodiments, the ends 202, 204 of the first lace 122, the ends 206, 208 of the second lace 124, or both sets of ends 202, 204, 206, 208 could be disposed on the first portion 165 in the tensioned state.

It should be understood that while the above process describes the tensile elements passing above and through an eyelet, or below and through an eyelet, in other embodiments, a substantially similar configuration of the lacing system can be arranged where the tensile elements are instead routed above and through an eyelet (where they have been described as being routed below or underneath), or where the tensile elements are instead routed below (or underneath) and through an eyelet (where they have been described as being routed above). Thus, such adjustments may be made during this method while still resulting in a substantially similar lacing arrangement.

As shown in FIGS. 1-8, article 100 may include provisions for securing, lacing, or tightening upper 102 through lacing system 150. For purposes of reference, it can be understood that lacing system 150 and/or article 100 can be configured to transition between a tensioned state and a loosened state. In other words, whereas FIGS. 1-8 depict article 100 in a substantially loosened state or open state (i.e., a state in which article 100 may readily receive a foot), FIGS. 9-11 and FIGS. 12-14 respectively depict two embodiments of a sequence where article transitions from the loosened state to the tensioned, closed, or secured state, where the article is deemed to be fully tensioned and ready for use by a given user. The tongue 126 is not shown in FIGS. 9-14 for clarity in the drawings. In the tensioned state, the laces 122, 124—in conjunction with other components such as lateral fastening portion 110 and medial fastening portion 112—may exert a compressive force or tension along an instep region and/or a vamp region of the article, as well as a portion of the ankle region 147. However, the lacing system 150 and/or the upper 102 may include an open or loosened state, where the article 100 has been loosened, and various portions are free to move or expand in different directions. In one embodiment, a user may adjust the laces 122, 124 to adjust the fit of a foot in the foot-receiving, interior cavity 103 of the article 100 (or remove a foot from the article 100) and transition the article 100 from the secured or closed state to the loosened or open state.

Figures 9, 10, 11:
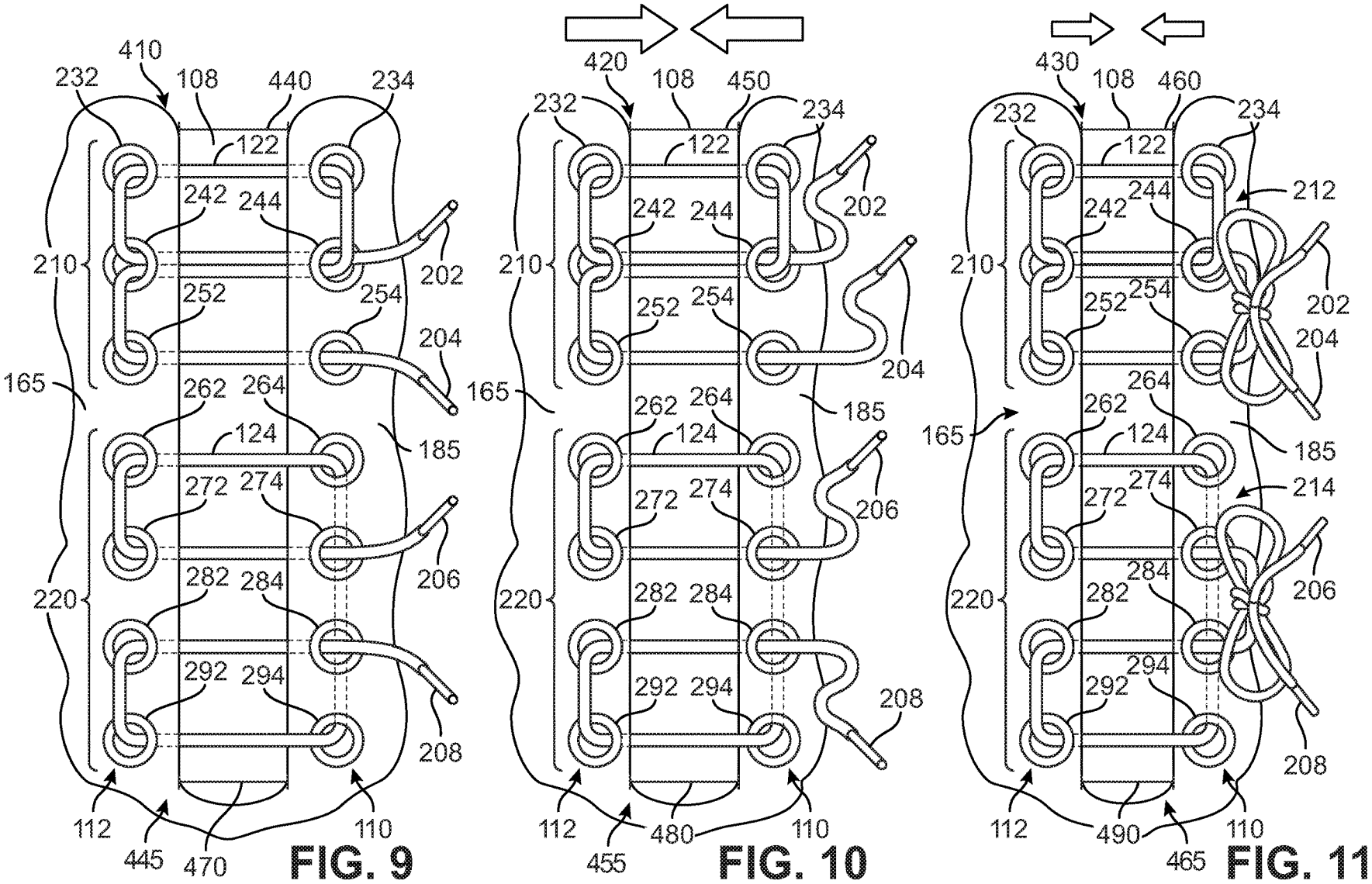
FIG. 9 is a schematic fragmentary view of the article of footwear of FIG. 8 including the lacing system.
FIG. 10 is a schematic fragmentary view of the article of footwear of FIG. 8 including the lacing system of FIG. 9 during tensioning of a first zone via the first lace and tensioning of a second zone via the second lace.
FIG. 11 is a schematic fragmentary view of the article of footwear of FIG. 8 including the lacing system of FIG. 10 with ends of the first lace secured to one another and ends of the second lace secured to one another.

Referring to FIGS. 9-11, one embodiment of a sequence of figures depicting some of the steps involved in a method of lacing the article 100 using the lacing system 150 is shown. However, it should be understood that the lacing process (also referred to as a tensioning process) described herein can occur through different steps, and the sequence is not limited by the sequence that is shown in FIGS. 9-11. Any series of steps that produce the configuration shown in FIG. 11 can be used, and the order of each step may vary significantly from that shown in FIGS. 9-11. In other embodiments, there may be a greater or lesser number of steps. In particular, it should be understood that the process depicted in FIGS. 9-11 is merely an example and other methods or steps of tightening an article may be used.

With respect to first fastening zone 210, in a first step 410 depicted in FIG. 9, the first lace 122 is arranged as described in detail with respect to FIGS. 3-8. It can be seen that lacing gap 108 is associated with a first distance 440 extending between medial fastening portion 112 and lateral fastening portion 110. In a second step 420 depicted in FIG. 10, first end 202 and/or second end 204 are pulled such that medial fastening portion 112 and lateral fastening portion 110 are tensioned and pulled toward one another (as depicted by inward pointing arrows), and lacing gap 108 is now associated with a second distance 450 extending between medial fastening portion 112 and lateral fastening portion 110, where second distance 450 is less than first distance 440. In a third step 430 depicted in FIG. 11, first end 202 and second end 204 can be further pulled and engaged together or looped with one another to provide any type of knot or secure association or attachment between the two ends such that there is no relative movement between the first and second ends at the knot or other attachment. In third step 430, lacing gap 108 is associated with a third distance 460 extending between medial fastening portion 112 and lateral fastening portion 110, where third distance 460 is less than first distance 440. Furthermore, though in some embodiments third distance 460 can be substantially similar to second distance 450, in other embodiments, third distance 460 can be less than second distance 450, providing an increase in tension at the medial fastening portion 112 and lateral fastening portion 110 in first fastening zone 210.

Similarly, in some embodiments, with respect to second fastening zone 220, in fourth step 445 of FIG. 9, the second lace 124 is arranged as described in detail with respect to FIGS. 3-8. In FIG. 9, it can be seen that lacing gap 108 is associated with a fourth distance 470 extending between medial fastening portion 112 and lateral fastening portion 110. In some embodiments, fourth distance 470 can differ from first distance 440, though in other embodiments they can be substantially similar. In fifth step 455 of FIG. 10, first end 206 and/or second end 208 are pulled (depicted by arrows) providing an increase in tension at the medial fastening portion 112 and lateral fastening portion 110 in second fastening zone 220. Furthermore, lacing gap 108 at the second fastening zone 220 is now associated with a fifth distance 480 extending between medial fastening portion 112 and lateral fastening portion 110, where fifth distance 480 is less than fourth distance 470. Furthermore, in some embodiments, fifth distance 480 can differ from second distance 450, though in other embodiments they can be substantially similar. In sixth step 465 of FIG. 11, first end 206 and second end 208 can be further pulled and then engaged together or looped with one another to provide any type of knot or secure association or attachment between the two ends such that there is no relative movement between the first and second ends at the knot or other attachment. In sixth step 465, lacing gap 108 is associated with a sixth distance 490 extending between medial fastening portion 112 and lateral fastening portion 110, where sixth distance 490 is less than fourth distance 470. Furthermore, though in some embodiments sixth distance 490 can be substantially similar to fifth distance 480, in other embodiments, sixth distance 490 can be less than fifth distance 480, providing an increase in tension between the medial fastening portion 112 and the lateral fastening portion 110 in second fastening zone 220. In addition, in some embodiments, sixth distance 490 can differ from third distance 460, though in other embodiments they can be substantially similar.

Thus, in different embodiments, first end 202 is disposed on or extends outward from lateral side 185 of the upper and second end 204 is disposed on or extends outward from lateral side 185 of the upper 102 when the article of footwear is in the tensioned state. Similarly, in some embodiments, first end 206 is disposed on or extends outward from lateral side 185 of the upper, and second end 208 is disposed on or extends outward from lateral side 185 of the upper when the article of footwear is in the tensioned state. In other embodiments, first end 202, second end 204, first end 206, and/or second end 208 can be disposed along medial side 165 in the tensioned state such as if the steps of FIGS. 9-11 are conducted but with laces 122, 124 extending through the eyelets in a mirror image of the arrangement shown (e.g., ends 202, 204 extending out of eyelets 242, 252 in FIG. 9, etc.). Still further, only one of the first lace 122 and the second lace 124 could be arranged in a mirror image of that shown so that the first and second ends 202, 204 are disposed at one side 165 or 185 and the ends 206, 208 are disposed at the other side 165 or 185.

By providing different fastening zones, in some embodiments, a user may adjust different regions of article 100 such that the different regions are associated with different degrees of tension. In some embodiments, a user may wish to increase the tension in the forefoot region, while having relatively less tension in the heel region. The lacing system 150 thus can provide a user with the ability to make adjustments to the footwear 100 that increase individual comfort and are more aligned with the user's preferences.

Figure 14:
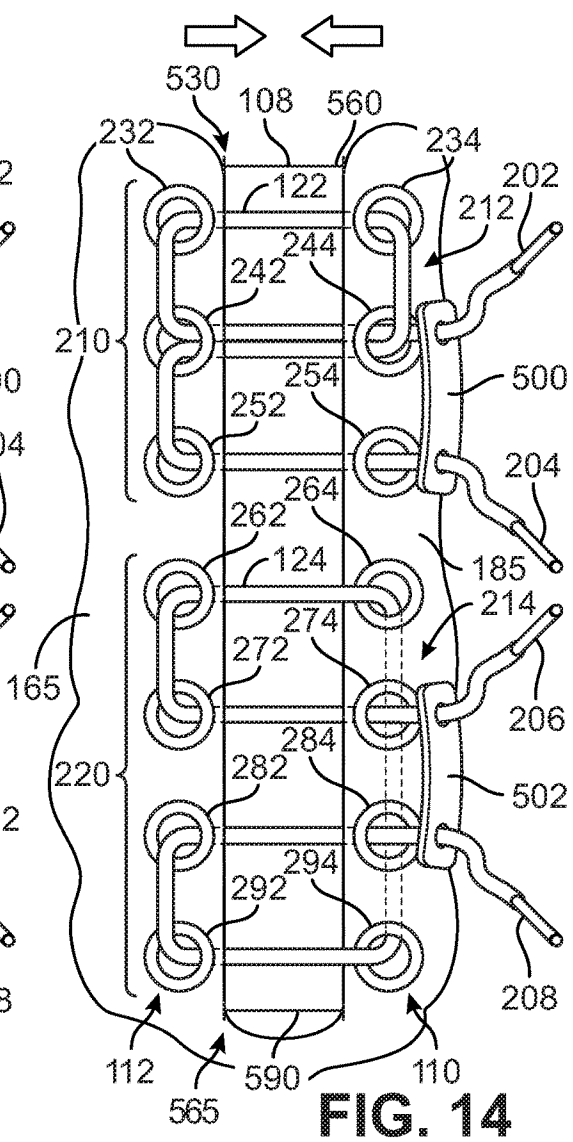
FIG. 14 is a schematic fragmentary view of the article of footwear of FIG. 8 including the lacing system of FIG. 13 with ends of the first lace secured to one another and ends of the second lace secured to one another.
Figure 13:
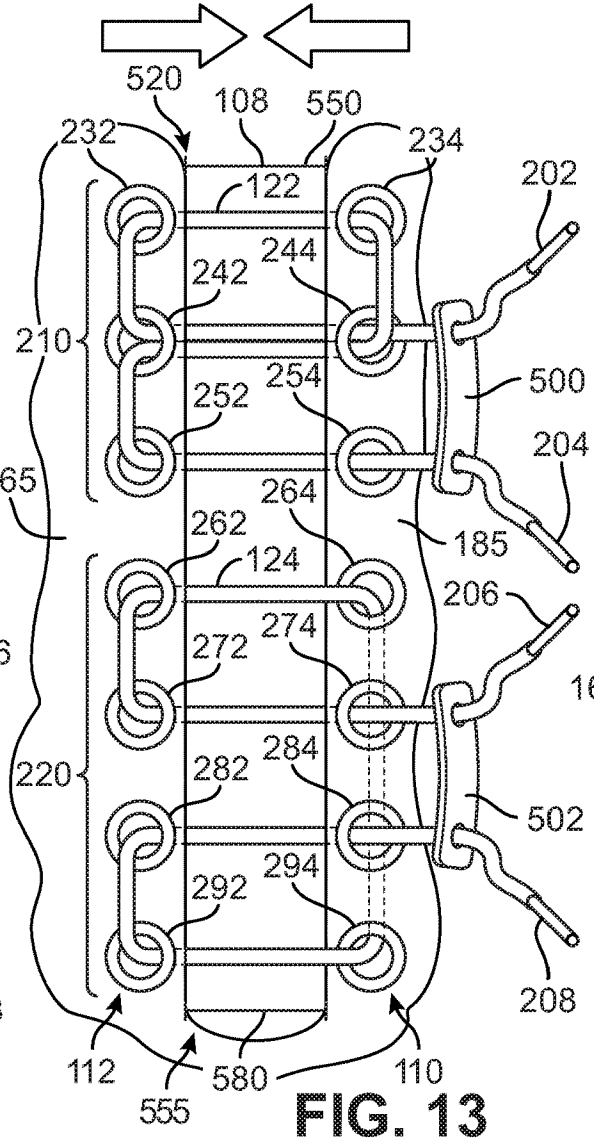
FIG. 13 is a schematic fragmentary view of the article of footwear of FIG. 8 including the lacing system of FIG. 12 during tensioning of a first zone via the first lace and tensioning of a second zone via the second lace.
Figure 12:
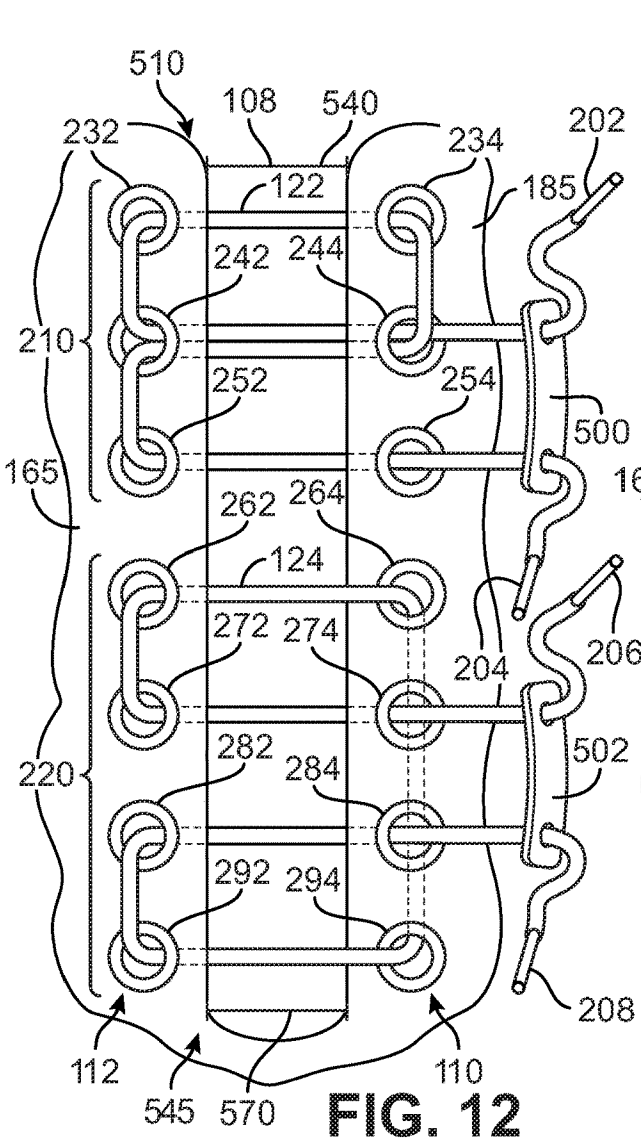
FIG. 12 is a schematic fragmentary view of the article of footwear of FIG. 8 including clasp devices secured on the laces.

Referring to FIGS. 12-14, another embodiment of a sequence of figures depicting the tightening of the article using the lacing system 150 is shown in which the securing or lacing of the laces 122, 124 is facilitated by the use of a clasp device. It should be understood that the tensioning process described herein can occur through different steps, and the sequence is not limited by the sequence that is shown in FIGS. 12-14. Any series of steps that produce the configuration shown in FIGS. 12-14 can be used, and the order of each step may vary significantly from that shown in FIGS. 12-14. In other embodiments, there may be a greater or lesser number of steps. In particular, it should be understood that the process depicted in FIGS. 12-14 is merely an example and other methods or steps of tightening an article may be used.

Furthermore, in additional embodiments, any suitable additional fasteners known in the art may be used alone or in combination with the listed fasteners. Embodiments can use any of the any of the clasp devices or other fastening mechanisms or components described in commonly owned U.S. Patent Application Publication No. 20170202313, to Spanks, or in commonly owned U.S. Patent Application Publication No. 20170202310 to Spanks et al., the entirety of both applications being herein incorporated by reference. Similarly, the laces described in either of these applications can also be understood to be available for use in the present disclosure.

As shown in FIG. 12, with respect to first fastening zone 210, in a first step 510, the first lace 122 is arranged as described in detail with respect to FIGS. 3-8. It can be seen that lacing gap 108 is associated with a first distance 540 extending between medial fastening portion 112 and lateral fastening portion 110. In a second step 520 shown in FIG. 13, first end 202 and/or second end 204 are pulled (depicted by arrows) providing an increase in tension in the medial fastening portion 112 and the lateral fastening portion 110. Furthermore, lacing gap 108 is now associated with a second distance 550 extending between medial fastening portion 112 and lateral fastening portion 110, where second distance 550 is less than first distance 540. This step may increase the length of each portion of lace that is "free" and available for engaging in a lacing or securing step in some embodiments. In a third step 530 depicted in FIG. 14, first end 202 and second end 204 can be engaged or secured together through a type of clasp device, as described above. In FIG. 14, first end 202 and second end 204 are engaged, secured, and/or joined to a first clasp device 500 on lateral side 185. First clasp device 500 can be used to quickly loosen and/or tighten the medial fastening portion 112 and the lateral fastening portion 110 at the first fastening zone 210 in some embodiments. In third step 530, lacing gap 108 is associated with a third distance 560 extending between medial fastening portion 112 and lateral fastening portion 110, where third distance 560 is less than first distance 540. Furthermore, though in some embodiments third distance 560 can be substantially similar to second distance 550, in other embodiments, third distance 560 can be less than second distance 550, providing an increase in tension and/or compression in first fastening zone 210.

Similarly, in some embodiments, with respect to second fastening zone 220, in fourth step 545 of FIG. 12, the second lace 124 is arranged as described in detail with respect to FIGS. 3-8. It can be seen that lacing gap 108 is associated with a fourth distance 570 extending between medial fastening portion 112 and lateral fastening portion 110. In fifth step 555 of FIG. 13, first end 206 and/or second end 208 are pulled (depicted by arrows) such that second fastening zone 220 experiences an increase in compression. Furthermore, lacing gap 108 is now associated with a fifth distance 580 extending between medial fastening portion 112 and lateral fastening portion 110, where fifth distance 580 is less than fourth distance 570.

In sixth step 565, first end 206 and second end 208 can be engaged to a type of clasp device on lateral side 185, as described above. In other words, in some embodiments, first end 206 and second end 208 can be engaged or secured to a type of clasp device, as described above. In FIGS. 12-14, first end 206 and second end 208 are engaged, secured, and/or joined to a second clasp device 502. Second clasp device 502 can be used to quickly loosen and/or tighten second fastening zone 220 in some embodiments. In different embodiments, the use of a clasp device can make the adjustment and cinching of the two fastening zones 210, 220 more efficient and accessible for a user.

In sixth step 565, lacing gap 108 is associated with a sixth distance 590 extending between medial fastening portion 112 and lateral fastening portion 110, where sixth distance 590 is less than fourth distance 570. Furthermore, though in some embodiments sixth distance 590 can be substantially similar to fifth distance 580, in other embodiments, sixth distance 590 can be less than fifth distance 580, providing an increase in tension and/or compression in second fastening zone 220.

As is evident in both FIGS. 11 and 14, the first lace 122 extends directly between all adjacent ones of the lace-receiving passages 212 of the first portion 165 (i.e., directly between medial eyelets 232 and 242, and directly between medial eyelets 242 and 254, but not directly between non-adjacent medial eyelets 232 and 252). The first lace 122 also extends directly between some of the adjacent ones of the lace-receiving passages 212 of the second portion 185 (i.e., directly between lateral eyelets 234 and 244, but not directly between lateral eyelets 244 and 254, and not directly between non-adjacent lateral eyelets 234 and 254). The second lace 124 extends directly between alternating adjacent ones of the lace-receiving passages 214 of the first portion 165 (i.e. between adjacent medial eyelets 262 and 272, between adjacent medial eyelets 282 and 292, but not between adjacent medial eyelets 272 and 282, and not between any non-adjacent medial eyelets of the first portion 165). The second lace extends directly between only some non-adjacent ones of the lace-receiving passages 214 of the second portion 185 (i.e. between non-adjacent lateral eyelets 264 and 294, but not between adjacent lateral eyelets 264 and 274, not between non-adjacent lateral eyelets 264 and 284, not between non-adjacent lateral eyelets 274 and 294, and not between adjacent lateral eyelets 284 and 294).

Figure 15:
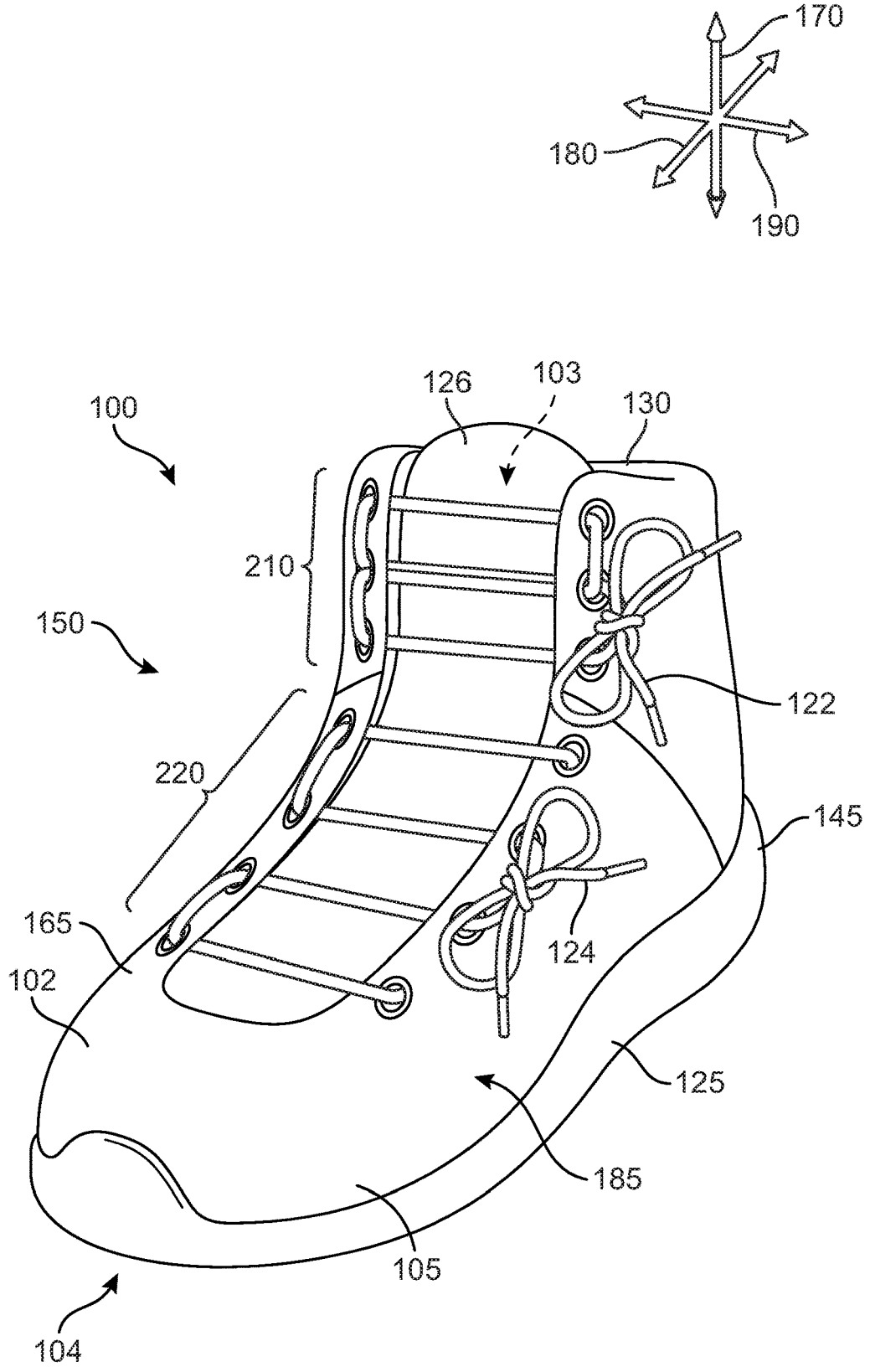
FIG. 15 is an isometric view of an embodiment of the article of footwear of FIG. 8 with ends of the laces secured to one another.

Referring now to FIG. 15, an isometric view of article 100 in the tensioned state is shown. Article 100 and lacing system 150 may provide a variety of benefits to a user. As shown in the Figures, first fastening zone 210 and second fastening zone 220 can be tensioned independently, allowing a user greater flexibility and the ability to provide more specialized or "fine" adjustments in different regions of article 100. Furthermore, the particular lacing arrangement described herein allows a dispersion of tension that can provide optimal comfort and stability to a user in some embodiments.

This description of features, systems, and components is not intended to be exhaustive and in other embodiments, the article may include other features, systems, and/or components. Moreover, in other embodiments, some of these features, systems, and/or components could be optional.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

What is claimed is:

1. An article of footwear comprising:

a body having an exterior, a longitudinal midline, a lateral axis perpendicular to the longitudinal midline, a first portion, and a second portion opposite the first portion across the longitudinal midline; and a lacing system including:

a first set of rows of lace-receiving passages in a first zone of the body;

a second set of rows of lace-receiving passages in a second zone of the body opposite the first zone across the lateral axis; wherein each row of the first set and each row of the second set includes a lace-receiving passage on the first portion and a lace-receiving passage on the second portion;

a first lace routed through each lace-receiving passage of the first set and having a first end and a second end both exiting from different rows of the lace-receiving passages of the first set on a same one of the first portion or the second portion; and a second lace routed through each lace-receiving passage of the second set and having a first end and a second end exiting from different intermediate rows of the lace-receiving passages of the second set on said same one of the first portion or the second portion;

wherein the first lace is arranged in a first asymmetric configuration across the longitudinal midline on the exterior such that the first lace is routed in a different configuration on a medial side of the article of footwear than on a lateral side of the article of footwear;

wherein the second lace is arranged in a second asymmetric configuration across the longitudinal midline on the exterior such that the second lace is routed in a different configuration on the medial side of the article of footwear than on the lateral side of the article of footwear;

wherein the first lace and the second lace are arranged in a third asymmetric configuration across the lateral axis on the exterior such that the first lace is routed in a different configuration than the second lace; and wherein two different non-consecutive portions of only the first lace extend between the same two lace-receiving passages of only an intermediate row of lace-receiving passages of the first set such that the two different non-consecutive portions contact each other in the first zone.

2. The article of footwear of claim 1, wherein the first lace extends directly between all adjacent rows in the first zone.

3. The article of footwear of claim 1, wherein the body is an upper;

wherein the first set of rows includes a first row, a second row adjacent the first row, and a third row adjacent the second row;

wherein the second set of rows includes a fourth row, a fifth row adjacent the fourth row, a sixth row adjacent the fifth row, and a seventh row adjacent the sixth row;

wherein the second lace extends:

directly between the medial side of the fourth row and the medial side of the fifth row in the second zone;

directly between the medial side of the sixth row and the medial side of the seventh row in the second zone; and directly between the lateral side of the fourth row and the lateral side of the seventh row in the second zone; and wherein the second lace extends beneath the upper between the lateral side of the fourth row and the lateral side of the seventh row.

4. The article of footwear of claim 1, wherein the first lace tensions the first zone of the body when the first end of the first lace and the second end of the first lace are pulled, and the second lace tensions the second zone of the body independently of the first lace and the first zone when the first end of the second lace and the second end of the second lace are pulled.

5. The article of footwear of claim 1, wherein the body is an upper, the first portion is the medial side of the upper, and the second portion is the lateral side of the upper; and wherein the first zone is disposed further rearward relative to the second zone.

6. The article of footwear of claim 1, further comprising:

a clasp device secured to the first end of the first lace and to the second end of the first lace.

7. The article of footwear of claim 1, wherein the first set of rows includes three rows, and the second set of rows includes four rows.

8. An article of footwear comprising:

an upper having an exterior, a longitudinal midline, a lateral axis perpendicular to the longitudinal midline, a first portion, and a second portion opposite the first portion across the longitudinal midline; and a lacing system comprising:

multiple rows of lace-receiving passages disposed in a first zone of the upper, each row including a lace-receiving passage disposed on the first portion and a lace-receiving passage disposed on the second portion;

multiple rows of lace-receiving passages disposed in a second zone of the upper spaced apart from and opposite the first zone of the upper across the lateral axis, each row including a lace-receiving passage disposed on the first portion and a lace-receiving passage disposed on the second portion;

a first lace extending through each of the lace-receiving passages in the first zone and including a first end and a second end exiting from two consecutive ones of the lace-receiving passages in the first zone both disposed at the first portion or both disposed at the second portion; and a second lace extending through each of the lace-receiving passages in the second zone and including a first end and a second end exiting from two consecutive ones of the lace-receiving passages in the second zone both disposed at the first portion or both disposed at the second portion;

wherein at least one row of the multiple rows in the second zone is between the first zone and the two consecutive ones of the lace-receiving passages in the second zone from which the first end and the second end of the second lace exit;

wherein the first lace is arranged in a first asymmetric configuration across the longitudinal midline on the exterior such that the first lace is routed in a different configuration on a medial side of the article of footwear than on a lateral side of the article of footwear;

wherein the second lace is arranged in a second asymmetric configuration across the longitudinal midline on the exterior such that the second lace is routed in a different configuration on the medial side of the article of footwear than on the lateral side of the article of footwear;

wherein the first lace and the second lace are arranged in a third asymmetric configuration across the lateral axis on the exterior such that the first lace is routed in a different configuration than the second lace; and wherein two different non-consecutive portions of only the first lace extend between the same two lace-receiving passages of only an intermediate row of lace-receiving passages of the first zone such that the two different non-consecutive portions contact each other in the first zone.

9. The article of footwear of claim 8, wherein the upper is tensioned in the first zone by the first lace independently of the second lace by pulling at least one of the first end and the second end of the first lace and securing the first end and the second end of the first lace to one another; and wherein the upper is tensioned in the second zone by the second lace independently of the first lace by pulling at least one of the first end and the second end of the second lace and securing the first end and the second end of the second lace to one another.

10. The article of footwear of claim 8, wherein at least some of the lace-receiving passages are eyelets extending through the upper.

11. The article of footwear of claim 8, wherein the first portion is the medial side of the article of footwear, and the second portion is the lateral side of the article of footwear.

12. The article of footwear of claim 11, wherein the first zone is rearward of the second zone.

13. The article of footwear of claim 12, wherein the upper is a high-top, the first zone is in an ankle region of the upper, and the second zone is in a forefoot region of the upper.

14. The article of footwear of claim 8, wherein the two consecutive ones of the lace-receiving passages from which the first end and the second end of the first lace exit are in rows of the multiple rows in the first zone that are nearest the second zone.

15. The article of footwear of claim 8, wherein the two consecutive ones of the lace-receiving passages from which the first end and the second end of the second lace exit are middle rows of the multiple rows in the second zone.

16. The article of footwear of claim 8, wherein the multiple rows of lace-receiving passages disposed in the first zone are three rows; and wherein the multiple rows of lace-receiving passages disposed in the second zone are four rows.

17. The article of footwear of claim 8, further comprising:

a clasp device secured to the first end and the second end of one of the first lace and the second lace.

* * * * *